United States Patent [19]

Lewis

[11] 4,280,029

[45] Jul. 21, 1981

[54] ELECTRICAL SWITCH

[75] Inventor: John W. Lewis, Baton Rouge, La.

[73] Assignee: The Dow Chemical Company, Midland, Mich.

[21] Appl. No.: 15,394

[22] Filed: Feb. 26, 1979

[51] Int. Cl.[3] ..... H01H 9/20

[52] U.S. Cl. ..... 200/50 R; 339/22 B; 361/341

[58] Field of Search ..... 200/50 A, 50 R, 50 AA, 200/239, 153 L, 321, 322, 323, 324, 318; 361/336, 341; 339/75 R, 75 M, 91 R, 22 R, 244 R, 244 B, 244 U, 244 C

[56] References Cited

U.S. PATENT DOCUMENTS

| | | | |
|---|---|---|---|
| 2,069,632 | 2/1937 | Thomas | 200/153 L |
| 3,903,384 | 9/1975 | De Visser et al. | 200/50 AA |

*Primary Examiner*—J. V. Truhe
*Assistant Examiner*—Morris Ginsburg
*Attorney, Agent, or Firm*—R. W. Selby

[57] ABSTRACT

An electrical switch comprising a base member; an electrical conducting contact member; a means in cooperative combination with the base member and the electrical contact member adapted to move the contact member outwardly from the base member toward an electrical bus member. The switch further includes a releasable clamping means in cooperative combination with the base member and the electrical contact member adapted to clamp the bus member and the electrical contact member together with a sufficient force to permit flow of electrical current between the bus member and the electrical contact member.

11 Claims, 3 Drawing Figures

ELECTRICAL SWITCH

BACKGROUND OF THE INVENTION

This invention relates to an electrical switch and more in particular to an electrical switch adapted for usage in a corrosive environment.

Electrical switches for starting and/or stopping the flow of electrical current through electrical systems are well known. "Knife-type" switches have previously been employed in systems requiring relatively high voltages and/or amperes. Where switches have been exposed to a corrosive environment, the electric conducting portions of the switches, which are generally a metal such as aluminum, or copper or alloys containing major portions of such metals, are frequently corroded, that is oxidized, sufficiently to reduce or entirely prevent the passage of electricity from an electrical source through the corroded switch.

It is, therefore, highly desirable to provide an electric switch capable of operation at relatively high voltages and/or amperes in a corrosive environment.

SUMMARY OF THE INVENTION

The hereinafter described invention is a particular electrical switch useful for starting and/or stopping the flow of electrical current through electrical systems located in corrosive environments. The electrical switch comprises a base member, an electrical conducting contact member, a means in cooperative combination with the base member and the electrical contacting member and a releasable clamping means. The electrical contacting member is adapted to move such contacting member outwardly from the base member toward an electrical bus member. The releasable clamping means is in cooperative combination with the base member and the electrical contacting member. Such clamping means is adapted to clamp the bus member and the electrical contacting member together with a sufficient force to permit flow of electrical current between the bus member and the electrical contact member.

DESCRIPTION OF THE DRAWING

The accompanying drawing further illustrates the invention.

Identical numerals, distinguished by a letter suffix, within the several figures represent parts having a similar function within the different embodiments.

DESCRIPTION OF THE PREFERRED EMBODIMENT

Figure 1:
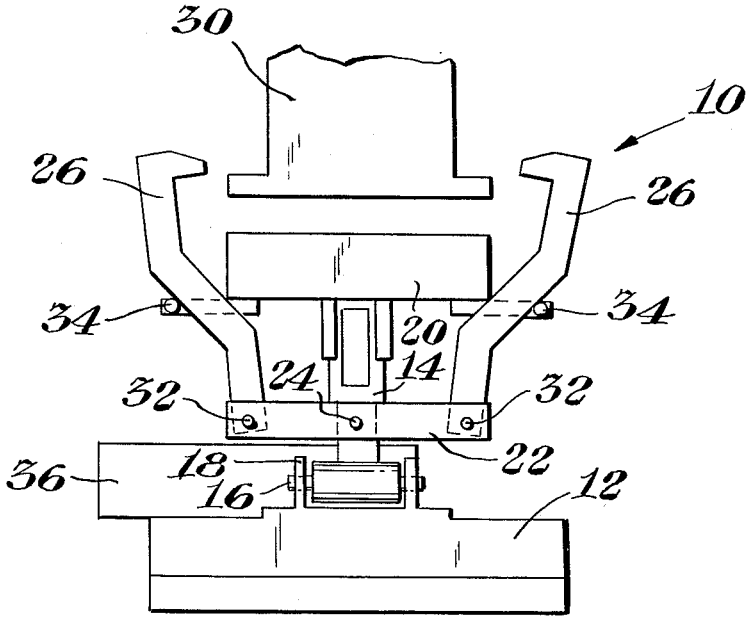
FIG. 1 is an end view of an electrical switch, in open position, of the present invention.

In FIG. 1 is shown a stationary electric switch 10. The switch 10 includes a base member 12 with a moving means 14 pivotably attached to the base 12 by means of a pivoting arm 16 passing through arms or lugs 18 of the base 12. The moving means 14 is suitably attached to an electric contact means such as plate 20. Such attachment of the moving means 14 to the plate 20 can readily be carried out by, for example, bolting, screwing, welding, slidably positioning a rod on the moving means 14 within a suitable reciprocal on the plate 20, and the like.

A generally lever-like arm 22 is pivotably attached to a substantially stationary portion, with respect to the plate 20, of the moving means 14. Such connection of the lever-like arm 22 to the moving means 14 can be accomplished by well known means, such as positioning a rod 24 through the lever 22 to permit rotation around the rod 24 or by use of ball bearings.

Clamping means 26 are connected in cooperative combination with the base member 12 and the plate 20. The clamps 26 are adapted to clamp the plate 22 to an electric bus bar 30 with a sufficient force to permit the flow of an electrical current between the bus 30 and the plate 20. The clamps 26 are pivotably attached to the lever arm 22 by means of, for example, pins for bearings 32 to afford an inward and outward motion of the clamps with respect to the plate 20. Retaining means or stops 34 are suitably attached to the plate 20 to hold the clamps 26 in an upward position.

The moving means 14 is adapted to push the plate 20 upwardly away from the base 12 toward the bus bar 30. Various types of well-known jacks, pistons, screw assemblies, and the like are operable as the moving means. In the present invention, it is preferred to use a moving means particularly suited to be retained in a substantially stationary (e.g., locked) position to maintain electrical contact between the plate 20 and the bus bar 30 when the moving means 14 is in an outward position; this is one reason a screw-type moving means is particularly preferred. The moving means 14 can be readily powered by an electrical, gas, hydraulic or, preferably, pneumatic motor, alone or in combination with a hydraulic system.

In a preferred embodiment, the pneumatic motor and movable portions of the moving means are substantially entirely enclosed within a corrosion resistant jacket assembly 36 when the switch 10 is in an open position. The corrosion jacket assembly 36 retards entrance of corrosive gases (such as, hydrogen halide, nitric acid and sulfuric acid fumes) or other substances into the motor and moving means 14. If desired, and when appropriate and well-known motors are utilized, the jacket assembly 36 can be filled with a suitable liquid, such as an oil, to prevent substantially all dirt or corrosive gases or other substances from entering into the motor and moving means 14.

Figure 2:
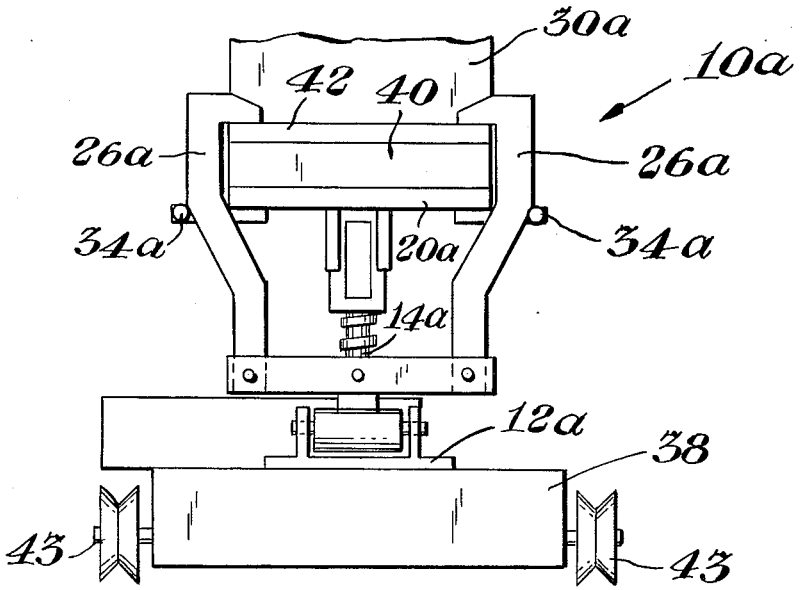
FIG. 2 is an end view of an electrical switch, in closed position, of the claimed invention.

In FIG. 2 is depicted an electrical switch **10*a* which is substantially the same described for FIG. 1 with the exception that a base member 12*a* is fixed to a wheeled, movable carriage 38. The electric switch 10*a* is shown in a closed position with electrical contact means or plate 20*a* being physically and electrically connected to an electric conducting facing member 40 held in contact with a bus contact plate 42 electrically connected to a bus bar assembly 30*a*. The facing member 40 and bus contact plate 42 can be adapted to be readily removed from the electric contact means 20*a*, and the bus bar assembly 30*a* when, for example, excessive wear or mechanical abuse becomes such that replacement is necessary to obtain continued satisfactory electrical contact between the facing member 40 and the bus contact plate 42. Wheels 43 are, optionally, grooved to permit the switch 10*a*** to roll upon rails from one location to another.

The general operation of the electric switch 10 will be described with reference to FIGS. 1 and 2. The mechanical differences and FIGS. 1 and 2 will not affect the hereinafter description of the operation of such switch. As aforementioned, the electrical switch 10 of FIG. 1 is in the open position. That is, the plate 20 and the bus bar 30 are not in contact with each other, and the moving means 14 is in a retracted position. When it is desired to close the switch, the motor drive for the moving means 14 is actuated to close, as shown in FIG. 2, a "screw jack-type" moving means 14*a* to extend and force the facing member 40 into contact with bus contact plate 42. Contact between the facing member 40 and the bus contact plate 42 is sufficient to provide flow of electricity from the bus bar 30*a* through the bus contact plate 42 and into the facing member 40. The high clamping pressure between the plate 20 and the bus bar 30 possible with the switch of the present invention can reduce the voltage drop between the plate 20 and the bus 30. The electric current is transferred from the facing member 40 to electrical equipment or another electrical system by appropriate and well-known electrical connections (not shown).

As the moving member 14*a* lifts the facing member 40 in a generally upward direction away from the base 12*a*, the clamps 26*a* are forced inwardly toward the facing member 40 and the bus contact plate 42 by retaining means or stops 34*a* moving upwardly simultaneously with the facing member 40. The stop 34a slidably glides along the exterior surface of the clamps 26*a* to align and force the clamps inwardly toward the facing member 40. The pivotable feature of the clamps 26*a* is suited to provide substantially uniform clamping between the adjacent surfaces of the facing member 40 and the bus contact plate 42.

In a like, though reverse, manner, the electrical switch of the present invention can be opened to stop current flow between the facing member 40 and the bus contact plate 42 by lowering moving means 14*a*. Also, the switch is readily adapted to operate automatically, manually and/or by available remote control systems.

Figure 3:
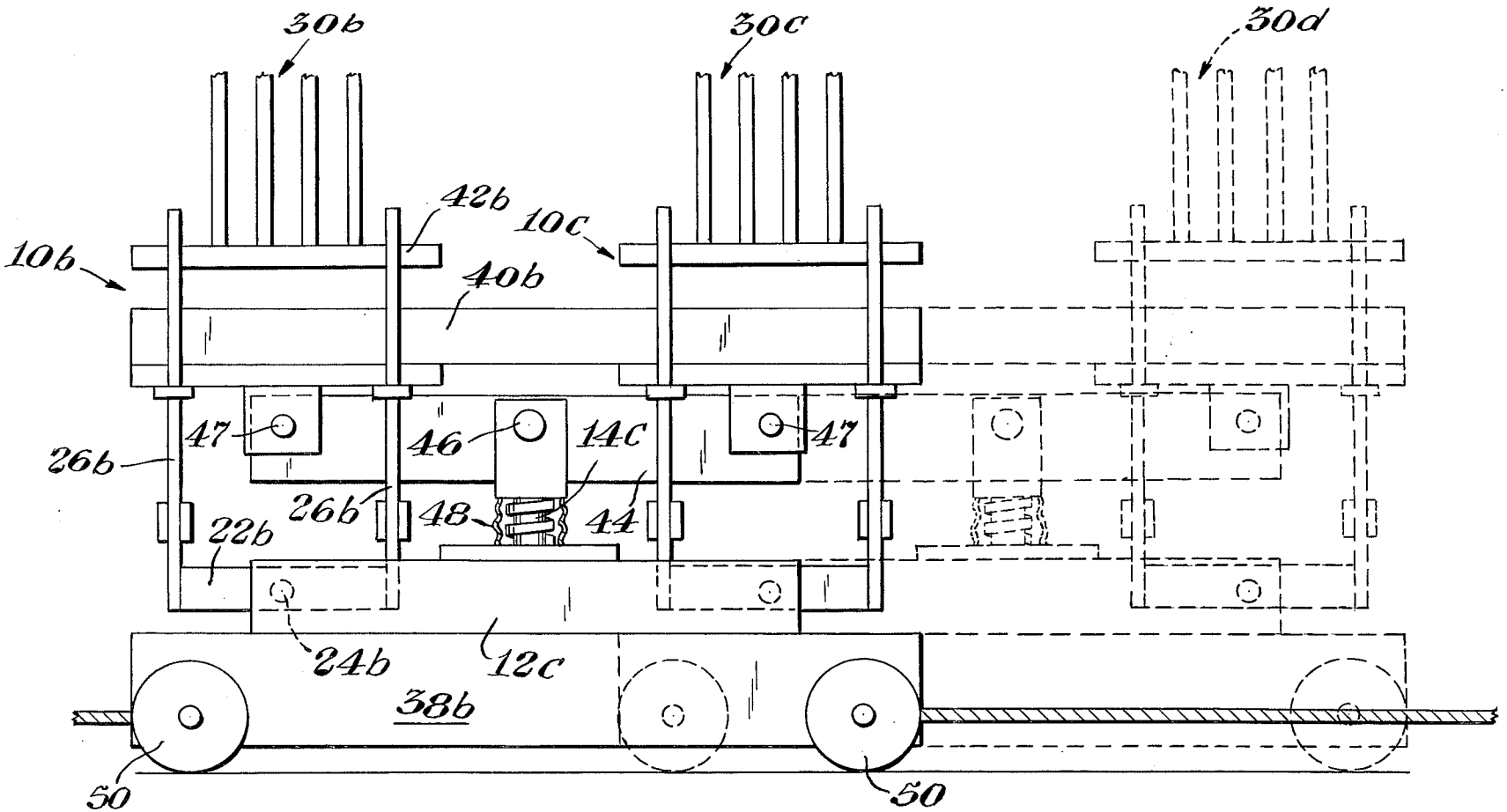
FIG. 3 is a side view of another embodiment of the present invention suitable for use with more than one bus bar.

In FIG. 3 is depicted a side view of switches similar to those shown in FIGS. 1 and 2. The embodiment of FIG. 3 shows flexible, electrical switches 10*b* and 10*c* positioned on a single base member 12*c* which, in turn, rests or is attached to a movable, wheeled carriage 38*b*. The electric switches 10*b* and 10*c* are identical in this embodiment and substantially the same as shown in FIG. 2. Clamps 26*b* are pivotably attached to a lever-like arm 22*b* which, in turn, is attached to the base 12*c* by means of a pivotable rod 24*b*.

A screw drive lifting means 14*c* rests on and is connected to the base 12*c*. The upper end portion of the lifting means 14*c* is pivotably attached to a support 44 by a pivot rod 46 or other common device to permit pivoting of the support 44 with respect to the raising means 14*c*. A single facing member 40*b* extends between, and is connected to the switches 10*b* and 10*c* by pivots 47.

As for the embodiment of FIGS. 1 and 2, the motor or other power unit used to actuate the raising means 14*c* is protected from corrosion caused by gases or other corrosive substances contained in the atmosphere in which the switches are operated. The raising means 14*c*, however, is additionally protected from corrosion by, for example, an enclosing bellows-like device 48 constructed from metal or, preferably, a commercially available fabric suited to minimize passage of corrosive gases or other substances. When the switch of FIG. 3 is operated, sufficient force is used to minimize and, preferably, prevent substantially all corrosive gases and substances from entering between the facing member 40*b* and the bus contact plate 42*b*. The specific configuration of the described electric switch apparatus is particularly suited for operation and corrosive environments for extended periods of time.

As shown by the solid lines of FIG. 3, the electric switches 10*b* and 10*c* are in an open position and located to be simultaneously connected to bus bars 30*b* and 30*c*. When it is desired to connect bus bars 30*c* and 30*d*, the carriage 38*b* is moved to the right in FIG. 3 to the position shown by the dotted lines.

As will be readily observed by those skilled in the art, various materials can be used to construct the herein described switches, usually, however, to obtain the desired mechanical strength and electrical conductivity, the materials will be metallic. For example, the electric conducting portion can be aluminum, an aluminum base alloy, or preferably copper or a copper base alloy. The non-electrically conductive portions can be iron, steel or a material of suitable strength which is more resistant to the particular corrosive environment than are iron and steel. If desired, the base 12*c* can be electrically insulated from the carriage 38*b* or, alternatively, the base 38*b* itself can be constructed of a common, commercially available electric insulating material to avoid undesired grounding of the switch. To avoid such electric grounding, wheels 50 can be constructed of an electric insulating material, such as rubber. Naturally, the wheels 50 can be of an electric conducting metal when grounding is unimportant, or the switches 10*b* and 10*c* are insulated in some other manner.

As is apparent from the foregoing specification, the apparatus of the present invention is susceptible of being embodied with various alterations and modifications, which may differ from those described in the preceding description. For example, the switch can, if desired, be so positioned to operate in any desired direction other than the preferred generally upwardly direction as hereinbefore described. For this reason, it is to be fully understood that all of the foregoing is intended to be illustrative and not to be construed or interpreted as being restrictive or otherwise limiting the present invention.

What is claimed is:

1. An electrical switch comprising:

(a) a base member;

(b) an electrical conducting contact member;

(c) a means in cooperative combination with said base member and said electrical contact member adapted to move said contact member outwardly from said base member toward an electrical bus member;

(d) a releasable clamping means in cooperative combination with said base member and said electrical contact member; said moving means and said clamping means in combination adapted to clamp and engage the bus member and said electrical contact member together with a sufficient force to permit flow of electrical current between the bus member and said electrical contact member.

2. The switch of claim 1 wherein said moving means is at least partially enclosed within a protective casing adapted to reduce corrosion of said moving means.

3. The switch of claim 1 wherein said clamping means is adapted to slidably align said electrical contact member before clamping together said contact member and the bus member.

4. The switch of claim 1 wherein said clamping means is pivotably connected to said base member.

5. The switch of claim 1 wherein said moving means is pivotably connected to said base member and is adapted to move said contact member in a generally upwardly direction from said base member to the bus member.

6. The switch of claim 5 in combination with a carriage attached to said base member, said carriage being suitable to carry the switch from one bus member to another bus member.

7. The switch of claim 2 wherein said moving means is a motor powered screw jack encased in a protective casing adapted to reduce corrosion of said moving means.

8. The switch of claim 5 wherein said electrical conducting contact member is adapted to be connected to at least two bus members.

9. The switch of claim 1 wherein the moving means is a threaded member.

10. The switch of claim 2 wherein the moving means is a threaded member.

11. An electrical switch comprising:

(a) a base member;

(b) an electrical conducting contact member;

(c) a means in cooperative combination with said base member and said electrical contact member adapted to move said contact member outwardly from said base member toward an electrical bus member, said moving means being a motor powered screw jack encased in a protective casing adapted to reduce corrosion of said moving means;

(d) a releasable clamping means in cooperative combination with said base member and said electrical contact member, said moving means and said clamping means in combination adapted to clamp the bus member and said electrical contact member together with a sufficient force to permit flow of electrical current between the bus member and said electrical contact member.

* * * * *